US005250124A

United States Patent [19]

Yamaguchi et al.

[11] Patent Number: 5,250,124

[45] Date of Patent: Oct. 5, 1993

[54] AMORPHOUS MAGNESIUM ALLOY AND METHOD FOR PRODUCING THE SAME

[75] Inventors: Hitoshi Yamaguchi, Nagano; Toshisuke Shibata, Miyagi; Akihisa Inoue, Miyagi; Akira Kato, Miyagi; Tsuyoshi Masumoto, 3-8-22, Kamisugi, Aoba-ku, Sendai-shi, Miyagi, all of Japan

[73] Assignees: Yoshida Kogyo K.K., Tokyo; Tsuyoshi Masumoto, Miyagi, both of Japan

[21] Appl. No.: 852,019

[22] Filed: Mar. 16, 1992

[30] Foreign Application Priority Data

Mar. 14, 1991 [JP] Japan ..... 3-74679
Mar. 14, 1991 [JP] Japan ..... 3-74681

[51] Int. Cl.[5] ..... C22C 45/00

[52] U.S. Cl. ..... 148/403; 420/405; 420/406

[58] Field of Search ..... 148/403, 406, 420; 420/405, 406

[56] References Cited

U.S. PATENT DOCUMENTS 4,990,198 2/1991 Masumoto et al. ..... 148/403

FOREIGN PATENT DOCUMENTS 0219628 4/1987 European Pat. Off. .
3-10041 1/1991 Japan .

*Primary Examiner*—George Wyszomierski
*Attorney, Agent, or Firm*—Armstrong, Westerman, Hattori, McLeland & Naughton

[57] ABSTRACT

A bulky amorphous magnesium alloy having heat-resistance and toughness is provided by setting the alloy composition as: $Mg_aM_bAl_cX_dZ_e$(M is at least one element selected from the group consisting of La, Ce, Mm (misch metal) and Y, X is at least one element selected from the group consisting of Ni and Cu, and Z is at least one element selected from the group consisting of Mn, Zn, Zr, and Ti, and, a=70~90 at %, b=2~15 at %, c=1~9 at %, d=2~15 at %, e=0.1~8 at %, a+b+c+d+e=100 at %).

5 Claims, 5 Drawing Sheets

AMORPHOUS MAGNESIUM ALLOY AND METHOD FOR PRODUCING THE SAME

BACKGROUND OF INVENTION

1. Field of Invention

The present invention relates to amorphous magnesium alloy having high specific strength and the method for producing the same.

2. Description of Related Arts

Crystalline magnesium alloy exhibits a high specific strength and hence can attain weight reduction of automobiles parts, which leads to savings in fuel. Representative crystalline magnesium alloys are based on Mg-Mn, Mg-Al, Mg-Zn, and Mgrare earth elements. The representative properties are 19~23kg/mm$^2$ of tensile strength and 10~13 of specific strength for the Mg-2wt %Mn alloy and 16~18kg/mm$^2$ of tensile strength and 10~12 of specific strength for Mg-2~3.5wt % Zn-0.5wt % Zr-2.5~4.5wt % R.E. (rare earth element) alloy.

The application development of the magnesium alloy is not as advanced as that of aluminum alloys which have already been employed for weight reduction of automobile parts, because the price of magnesium alloy is high, the specific weight is low, and further there is a problem with corrosion in ambient air.

It is known that aluminum-alloy, which is one of the light alloys, enhances strength, by vitrification, thus leading to further enhancement of the specific strength as compared with crystalline alloys. One example of an amorphous aluminum alloy is Al-R.E.-transition element alloy, whose tensile strength amounts to 100kg/mm$^2$.

It is known that the composition of magnesium alloys which can be vitrified are limited to Mg-Al-Ag and Mg-R.E.-transition metal. However, the former amorphous Mg-Al-Ag alloy has a low crystallizing temperature and hence low heat resistance. In addition, this alloy embrittles after production and shelving at room temperature in ambient air. The latter Mg-R.E.-transition metal alloy is such a brittle material that it is destroyed by bending at room temperature in most cases.

Since the specific weight of magnesium is 1.7, which is lower than that of aluminum (2.7), when any amorphous magnesium alloy attains tensile strength of 50kg/mm$^2$ or more, and incurs neither post-heating embrittlement due to heating at high temperature nor transformation from an amorphous state to crystals during holding at normal temperature, the so-provided amorphous magnesium alloy could be used, in practice, for light-weight parts.

Conventionally, the amorphous alloys have been produced by a single-roll apparatus for melt-quenching, which can impart a cooling speed of $10^4$K/sec or more and which can provide a thickness of from 10 to 301$\mu$m and width of 100 mm. Amorphous alloys with a wider area are produced by the gas-phase deposition method. Their thickness is a few micro meters. The amorphous alloys produced by these method are very thin. In order to produce thicker or bulky amorphous alloys, a ribbon produced by the single-roll method is mechanically crushed and then the crushed powder is hot-consolidated by means of, for example, extrusion and pressing. Alternatively, the amorphous powder produced by gas atomizing is consolidated by explosion bonding. However, it is difficult to produce bulky amorphous materials with 100% of amorphous structure by these methods, because the pressing and forming conditions for holding the amorphous structure are strict. In addition, since the extrusion, pressing and the like must be carried out at a temperature less than the crystallizing temperature, the required forming force is so great, that the production cost becomes impractically high.

SUMMARY OF THE INVENTION

It is therefore an object of the present invention to provide an amorphous magnesium alloy which can attain tensile strength of 50kg/mm$^2$ or more, and incurs neither post-heating embrittlement due to heating at high temperature nor transformation from an amorphous state to crystals when maintained at normal temperature, and which could be used, in practice, for light-weight parts.

It is another object of the present invention to provide a method for producing various shapes of bulky amorphous magnesium alloy relatively easily and an inexpensive method, with the amorphous magnesium alloy exhibiting the characteristics of the magnesium alloy, i.e., a high specific strength.

In accordance with the present invention, there is provided an amorphous magnesium alloy having a composition of $Mg_aM_bAl_cX_dZ_e$ (M is at least one element selected from the group consisting of La, Ce, Mm(misch metal) and Y, X, is at least one element selected from Ni and Cu, and Z is at least one element selected from the group consisting of Mn, Zn, Zr, and Ti, and, a=70~90 at %, b=2~15 at %, c=1~9 at %, d=2~15 at %, e=0.1~8 at %, a+b+c+d+e=100 at %). The alloy of this composition can be shaped into the form of an amorphous ribbon by the well known single-roll method. This ribbon is cut or laminated to use as the practical material. The material of the above composition neither undergoes transformation from the amorphous to crystalline state when subjected to a tensile test or when heated for 100 hours at 150° C., which is close to the crystallizing temperature, nor embrittlement. Non-transformation was confirmed by X-ray diffraction.

The method according to the present invention is: the magnesium alloy having the composition of $Mg_aM_BAl_CX_dZ_e$ mentioned above is cooled to a predetermined temperature in a passage for feeding the alloy melt into a mold and, the alloy melt is subsequently introduced into a mold for solidifying the alloy melt, where secondary cooling is carried out.

More specifically, the method for producing an amorphous magnesium alloy, according to the present invention, is characterized in that an alloy melt having composition of $Mg_aM_bAl_cX_dZ_e$(M is at least one element selected from the group consisting of La, Ce, Mm(misch metal) and Y, X is at least one element selected from Ni and Cu, and Z is at least one element selected from the group consisting of Mn, Zn, Zr, and Ti, and, a=70~90 at %, b=2~15 at %, c=1~9 at %, d=2~15 at %, e=0.1~8 at %, a+b+c+d+e=100 at %) and ΔT=Tx(crystallization temperature)−Tg (glass transition temperature) >10K is subjected to a primary cooling as the alloy melt flows through a flowing passage at a cooling speed Vc, thereby cooling the alloy melt to a temperature in the vicinity of the melting point, and is then subjected to a secondary cooling, in which the alloy melt is fed into a mold and cooled to the glass transition temperature (Tg) at a cooling higher than the initial cooling speed Vc. Vc is such a cooling speed that if the secondary cooling is carried out at Vc a partial crystallization occurs.

The alloy composition is first described.

Mg is the basic metal which is indispensable for weight reduction. When its content (a) is less than 70 atomic %, the specific weight of the alloy becomes high. On the other hand, when the Mg content (a) is more than 90%, it becomes difficult to vitrify the alloy.

M and X are elements necessary for vitrification. When the content (b) of M is more than 15 at %, the mixed structure of amorphous phase and crystalline (compound) phase are formed and the strength is decreased. On the other hand, when the content (b) of M is less than 2 at %, the structure becomes totally crystalline. The content (d) of X may be low, in the case where the content (b) of M is high. However, vitrification becomes easy when the content (d) of M is 2 at % or more. On the other hand, when the content (d) of M is more than 15 at %, a brittle amorphous structure is formed.

Al forms a strong oxide film on the surface of the magnesium and enhances the corrosion resistance of the magnesium against water, air and the like. When the content (c) of aluminum is less than 1 at %, its effect for enhancing the corrosion resistance is slight. On the other hand, when the content (c) of aluminum is more than 9 at %, the toughness of the amorphous alloy is lessened.

Zr, Ti and/or Mn in an amount (e) of 0.1 at % or more, are necessary for imparting heat-resistance to the alloy. On the other hand, when the content (e) is more than 8 at %, vitrification is impeded. Zn in an amount (e) of 0.1 at % or more is effective for enhancing the strength. Zn in a content of 8 at % or more impedes the vitrification. Preferably, Zn is added together with Zr, Ti and/or Mn.

DESCRIPTION OF PREFERRED EMBODIMENTS

Figure 1:
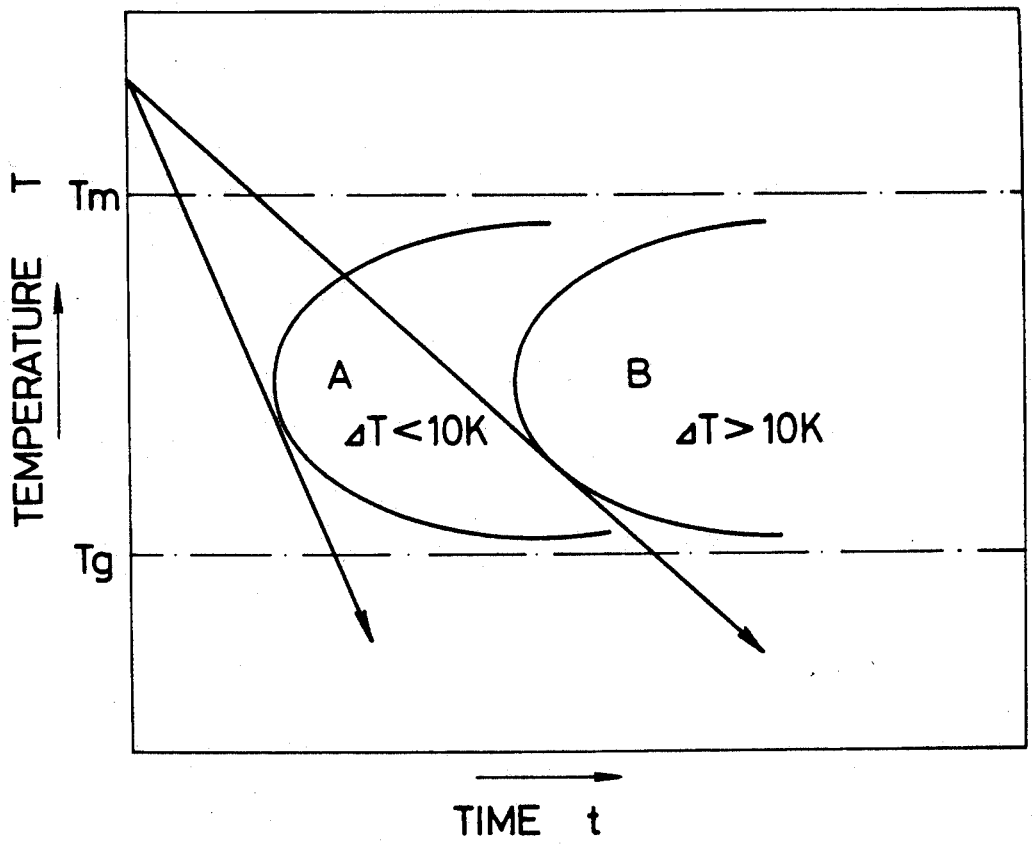
FIG. 1 is a graph illustrating continuous transformation.

When a thick amorphous alloy is to be produced by means of casting at a relatively slow cooling speed, the magnesium alloy must have a difference of the absolute temperature (AT) between the glass-transition temperature (Tg) and the crystallization temperature (Tx) of 10K or more (c.f. FIG. 1). Crystals are formed in a range the rightside of the curve denoted by AB in FIG. 1. As is shown in FIG. 1, at $\Delta T > 10K$, the crystal-forming region shifts toward a longer time span.

Figure 2:
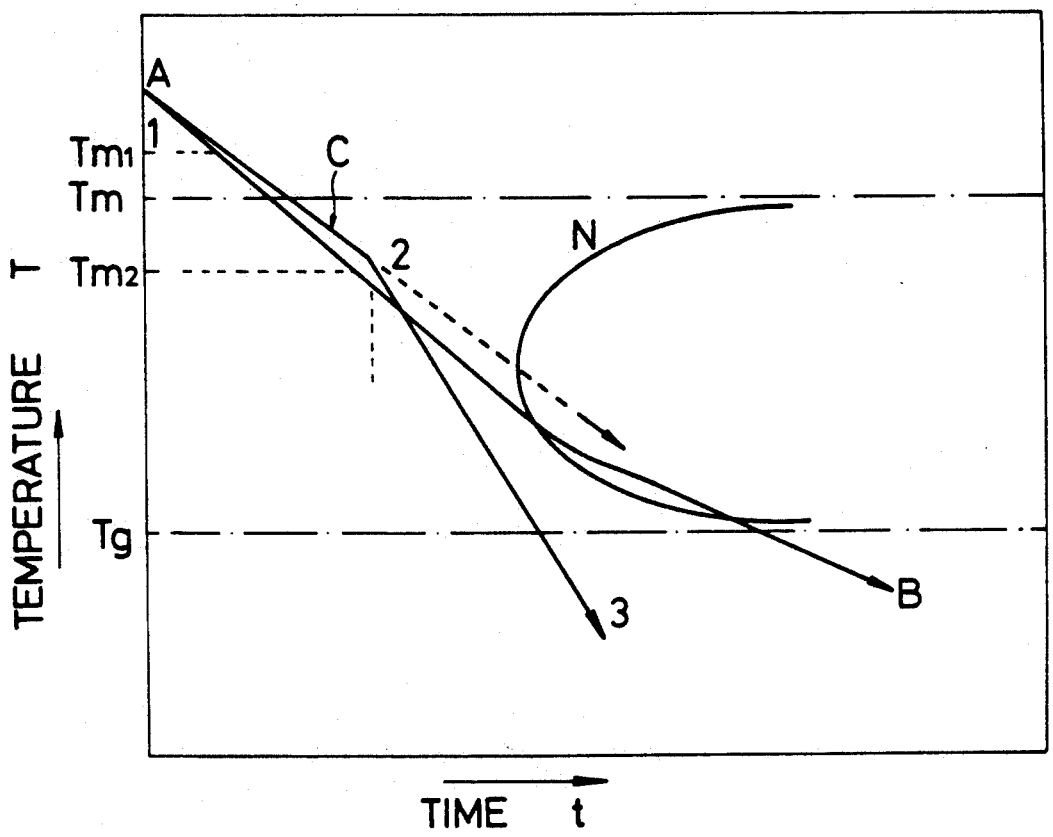
FIG. 2 is a graph illustrating continuous transformation in two-stage cooling.

As is shown in FIG. 2, the cooling at the initial stage is carried out at approximately the melting temperature of the alloy at such a cooling speed that if the alloy were cooled at this rate down to Tg, partial crystallization would occur. Subsequent to the initial cooling stage, the secondary cooling stage is carried out at a higher cooling speed than the initial cooling stage. The two-stage cooling is carried out to produce a relatively thickly cast amorpous magnesium alloy, while avoiding passing through the crystallizing area (N).

If great heat-withdrawal is made in the primary cooling stage as shown by the dotted line in FIG. 2, transit through the crystallizing region can be avoided, but such a cooling speed is difficult to achieve by casting. In order to mitigate the cooling load imposed in the secondary cooling stage to vitrify the magnesium alloy, the cooling speed in the primary cooling stage is preferably $10^2$K/sec or more.

According to the preferred primary cooling stage, the magnesium alloy is caused to flow from a melt reservoir to a passage, which is drawn in the form of a nozzle or an orifice, and, the temperature of the melt issuing out of the passage is lowered in proximity of the melting point of the magnesium alloy. This preferable cooling enables the easy attainment of a cooling speed of $> 10^2$K/sec. Thorough cooling can be carried out in the subsequent secondary cooling by means of forcing close contact between the melt and the cooling metal-mold, hence increasing the heat conduction between them.

The mold is made of metal or other material with good heat-conductivity. The mold is preferably water-cooled. The magnesium-alloy melt, which is sufficiently super-cooled in the primary cooling stage, is preferably pressure cast or centrifugally cast at 5OG or more, C being the acceleration of gravity. A high cooling speed is thus obtained.

The bulky material, which can be produced by the method of the present invention, is from 1 to 5 mm in thickness. In addition, amorphous magnesium-alloy having various shapes can be produced by changing the shape of the mold. The bulky material can be used for reinforcing aluminum alloy to provide a composite material.

The casting method according to the present invention is described with reference to FIGS. 1 and 2.

The primary cooling zone corresponds to a region between 1 and 2 shown in FIG. 2. The secondary cooling zone corresponds to a region between 2 and 3 shown in FIG. 2. In the primary cooling zone, the temperature should be lowered below Tm (melting point) as soon as possible. That is, the end point of the primary cooling should be lowered into the proximity of $Tm_2$. However, for a smaller product, whose heat capacity is low, primarily cooling can be carried out in such a manner that the secondary cooling starts at $Tm_1$. If the primary cooling is not carried out, the cooling speed varies as shown schematically by A-B in FIG. 2. The end point of the primary cooling may be line $Tm \pm 20k$. The secondary cooling may not be intensified, because the heat of the melt had been withdrawn in the primary cooling zone. This line A-B indicates that, crystallization occurs if only primary cooling is carried out to cool a cast product with a great volume, because the heat-emission speed from the mold usually slows with the lapse of time after casting, and, hence the cooling pattern crosses the crystallization curve.

Since the heat emission in the secondary cooling zone can be reduced, the cooling speed in the secondary cooling zone can be made so high that the cooling does not cross the curve where crystallization takes place. Even a thick product can therefore be vitrified.

The present invention is described hereinafter with reference to the drawings.

EXAMPLE 1

Figure 3:
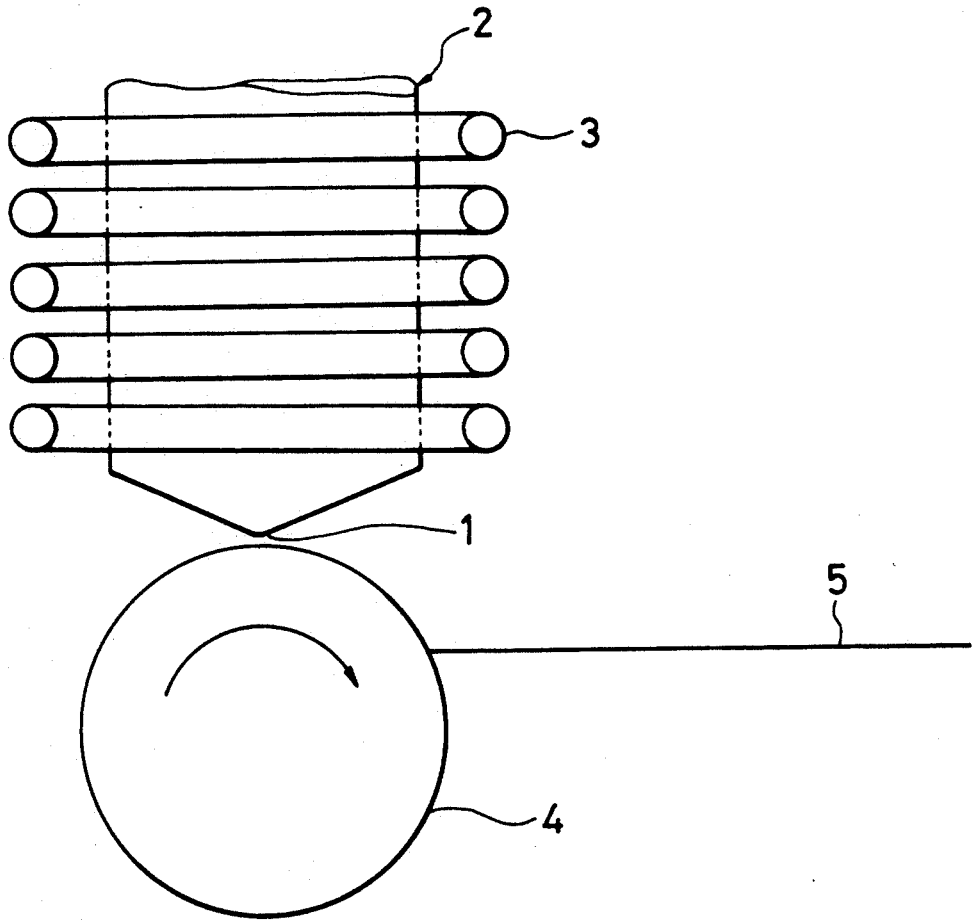
FIG. 3 illustrates a single-roll cooling apparatus.

Magnesium alloys, whose compositions are given in Table 1, were preliminarily prepared and then heated and melted in a high-frequency induction furnace, which was equipped with a melting crucible 2 made of quartz and a high-frequency heater (FIG. 3). The melt was then injected by means of pressure of argon gas through a slot 1 (0.5 mm in diameter) in the quartz melting crucible 2 onto the roll 4 made of copper, which was installed directly beneath the crucible 2. The alloy melt was brought into direct contact with the surface of the roll 4 and was rapidly solidified to obtain an alloy foil strip 5. This method is the single roll method which is generally well known for producing amorphous alloys.

The results of X-ray diffraction are shown in "Structure" in Table 2. In order to test the toughness directly after production, the foil strips were subjected to 180° tight contacting and bending around a round frame having a diameter of 0.5 mm. The test results are shown in "Toughness" in Table 2. In addition, after heating at 150° C. for 100 hours, the same tightly contacting and bending test was carried out. The test results are shown in "Post-heating Toughness" in Table 2.

From Table 2, it is apparent that the properties of the inventive alloys are superior to those of the comparative crystalline and amorphous alloys.

TABLE 1

Compositions of Inventive and Comparative alloys

| | Chemical Composition (at %) | | | | | | | | | | |
|---|---|---|---|---|---|---|---|---|---|---|---|
| | Mg | La | Ce | Mm | Y | Al | Ni | Cu | Mn | Zn | Zr |
| Inventive | | | | | | | | | | | |
| 1 | Bal | 10 | — | — | — | 3 | — | 15 | 3 | — | — |
| 2 | " | — | 10 | — | — | 3 | — | 10 | 2 | — | — |
| 3 | " | — | — | 10 | — | 3 | — | 12 | 2 | — | — |
| 4 | " | — | — | — | 10 | 3 | — | 14 | 2 | — | — |
| 5 | " | — | — | — | 10 | 3 | — | 10 | 2 | — | — |
| 6 | " | 10 | — | — | — | 3 | 10 | — | 2 | — | — |
| 7 | " | — | — | 8 | — | 5 | — | 10 | — | 5 | — |
| 8 | " | — | — | 8 | — | 5 | — | 10 | — | 4 | 0.5 |
| 9 | " | — | 5 | — | — | 3 | — | 12 | — | 5 | — |
| 10 | " | — | — | — | 5 | 5 | 10 | — | — | 1 | — |
| 11 | " | 5 | — | — | — | 4 | 5 | — | — | — | 1 |
| Comparative | | | | | | | | | | | |
| 1 | Bal | 1 | — | — | — | 5 | — | 10 | 8 | — | — |
| 2 | " | — | 10 | — | — | — | — | 1 | — | 5 | — |
| 3 | " | — | — | 8 | — | 6 | — | — | — | 5 | — |
| 4 | " | — | 10 | — | — | 15 | — | 10 | — | 5 | — |
| 5 | " | — | — | 15 | — | 5 | — | 20 | — | — | 3.0 |

TABLE 2

Properties of Inventive and Comparative Alloys

| | Structure | Toughness | Tensile Strength (Kg/mm2) | Post-heating Toughness |
|---|---|---|---|---|
| Inventive | | | | |
| 1 | Amorphous | Possible | 85 | Possible |
| 2 | Amorphous | Possible | 98 | Possible |
| 3 | Amorphous | Possible | 76 | Possible |
| 4 | Amorphous | Possible | 65 | Possible |
| 5 | Amorphous | Possible | 75 | Possible |
| 6 | Amorphous | Possible | 82 | Possible |
| 7 | Amorphous | Possible | 78 | Possible |
| 8 | Amorphous | Possible | 93 | Possible |
| 9 | Amorphous | Possible | 88 | Possible |
| 10 | Amorphous | Possible | 102 | Possible |
| 11 | Amorphous | Possible | 75 | Possible |
| Comparative | | | | |
| 1 | Crystalline | Impossible | 65 | Impossible |
| 2 | Amorphous | Possible | 65 | Impossible |
| 3 | Crystalline | Possible | 32 | Impossible |
| 4 | Amorphous | Impossible | 75 | Impossible |
| 5 | Crystalline | Impossible | 38 | Impossible |

EXAMPLE 2

Figure 4:
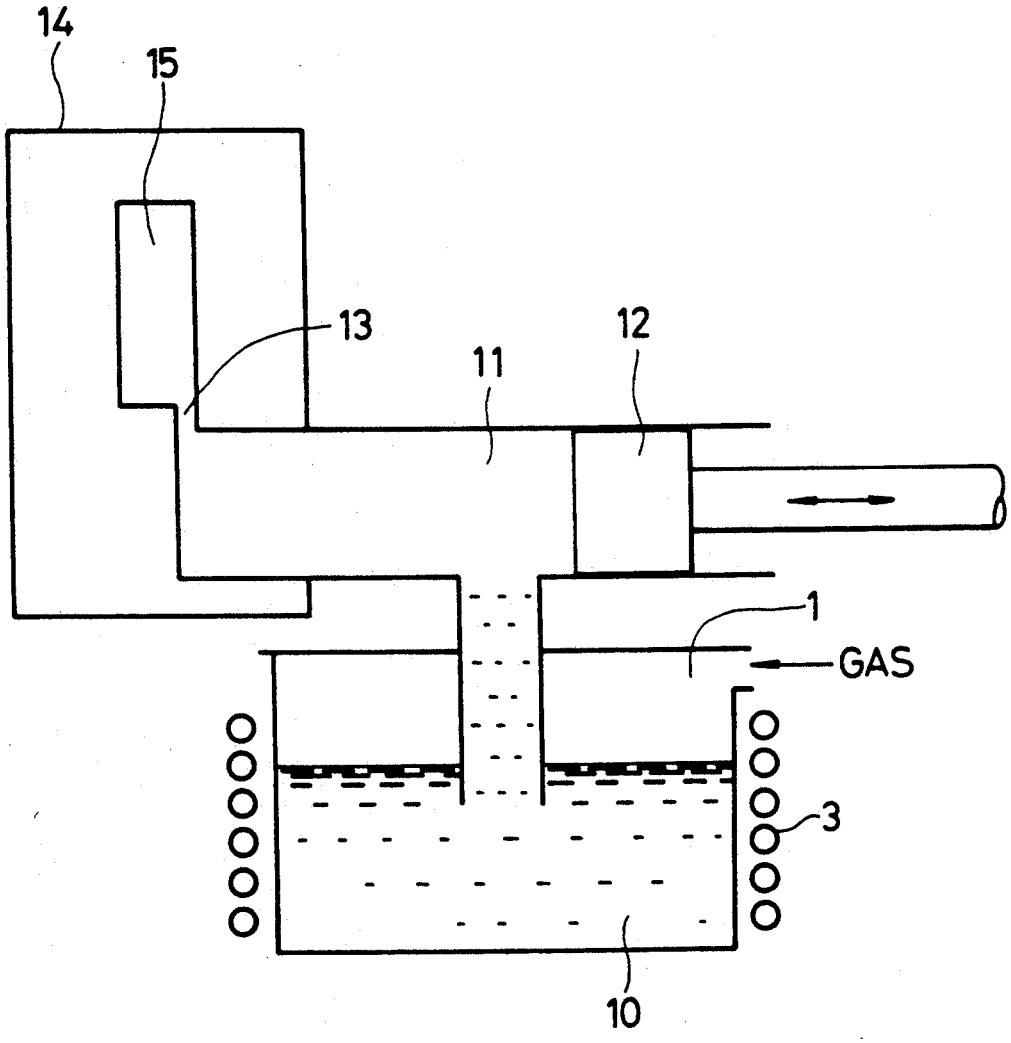
FIG. 4 illustrates a casting apparatus using a pressing method.

A 2 mm thick, 30 mm wide and 30 mm long amorphous magnesium alloy having a composition of $Mg_{79}Ni_{10}Y_5Al_5Zn_1$ was produced in this example by using a metallic-mold casting apparatus shown in FIG. 4. The magnesium alloy melt 10 was prepared by the heater coil 3 in the crucible 1. The magnesium-alloy melt was injected through the nozzle 13 into the die-cavity 15 of the metallic mold 14. The entire metallic-mold casting apparatus was placed in a box so as to optionally prepare the vacuum and inert atmosphere. The respective raw materials were measured and then charged in the crucible I made of calcia, and were high-frequency melted by the heater coil 3. The alloy melt 10 was held at a temperature 100° C. higher than the melting point of the alloy. Gas was introduced above the alloy melt 10 from a nozzle opened above the crucible 12 s as to apply 0.5 kg/cm$^2$ of pressure onto the alloy melt 10 and then introduce it into the melt reservoir 11. Subsequently, the melt was pressed by the plunger 12 at a pressure of 300 kg/cm$^2$ to introduce it into the die cavity 15 of the metallic mold 14. The nozzle 13 was 10 mm long and is longer than the length (5 mm) of the ordinary die-casting nozzle so as to increase the temperature drop in the nozzle. A thermocouple was inserted into the metallic mold to measure the temperature, which revealed that the temperature of the magnesium melt in the metallic mold was virtually in proximity of the melting point. This indicates that the primary cooling is completed at the outlet of the nozzle 13. The melt was then subjected to the secondary cooling in the metallic mold to solidify the melt. Heat-exchange between the metallic mold and the melt was continued in the secondary cooling zone. After thorough cooling, the product was withdrawn out of the metallic mold. The withdrawal could be facilitated by means of thinly applying on the metallic mold a mineral oil or the like as as parting agent. Samples were cut from the products to investigate the structure by means of X-ray diffraction, which showed a halo pattern peculiar to the amorphous alloy. In addition, the strength and hardness were the same as the ribbon materials.

EXAMPLE 3

Figure 5:
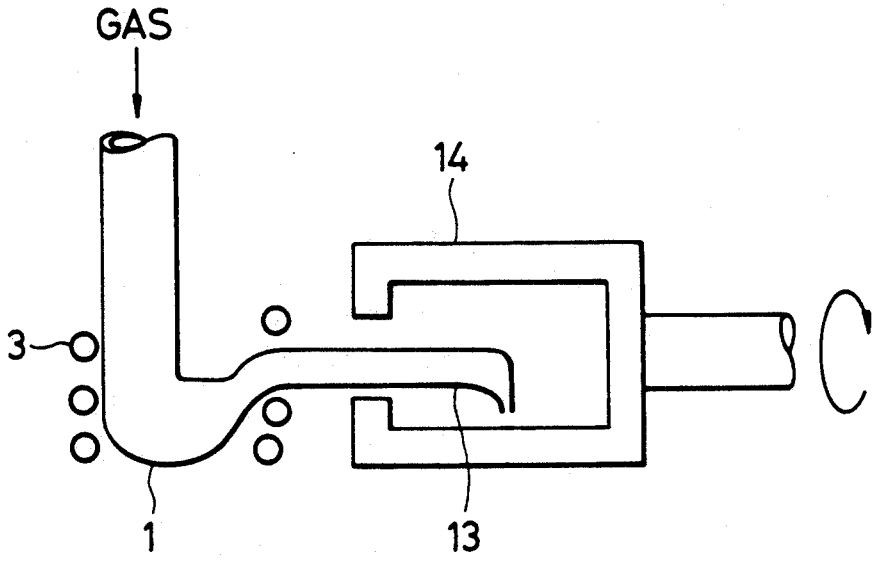
FIG. 5 illustrates a centrifugal casting apparatus.

The respective elements were charged in the crucible shown in FIG. 5, so as to provide the $Mg_{85}Ni_5La_5Al_4Zr_1$ composition. A melt 100° C. higher than the melting point was caused to flow through a nozzle 13 and then poured into the metallic mold 14 102 mm in diameter, which rotated at 300 rpm. A cylindrical product having a cross section of 2 mm×2 mm and central diameter of 100 mm was the result.

EXAMPLE 4

Alloys having the compositions given in Table 3 were cast by the method of Example 3. The glass-transition temperature (Tg) and the crystallization temperature (Tx) were measured. The values ΔT (=Tx−Tg) shown in Table 4 were obtained. Since the cast product of the comparative examples were crystallized, ribbons were prepared by the single-roll method, which could provide the cooling speed of $10^5$K/sec or more, and were subjected to measurement of the vitrifying temperature (Tg) and the crystallization temperature (Tx). The results indicate that, when the value of ΔT (=Tx−Tg) is 10 K or more, an amorphous cast product can be obtained.

TABLE 3

| | Chemical Composition (at %) | | | | | | | | | | |
|---|---|---|---|---|---|---|---|---|---|---|---|
| | Mg | La | Ce | Mm | Y | Al | Ni | Cu | Mn | Zn | Zr |
| Inventive | | | | | | | | | | | |
| 1 | Bal | 10 | — | — | — | 3 | — | 15 | 2 | — | — |
| 2 | " | — | 10 | — | — | 3 | — | 10 | 2 | — | — |
| 3 | " | — | — | 10 | — | 3 | — | 12 | 2 | — | — |
| 4 | " | — | — | — | 10 | 3 | — | 14 | 2 | — | — |
| 5 | " | — | — | — | 10 | 3 | — | 10 | 2 | — | — |
| 6 | " | 10 | — | — | — | 3 | 10 | — | 2 | — | — |
| 7 | " | — | — | 8 | — | 5 | — | 10 | — | 5 | — |
| 8 | " | — | — | 8 | — | 5 | — | 10 | — | 4 | 0.5 |
| 9 | " | — | 5 | — | — | 3 | — | 12 | — | 5 | — |
| 10 | 79 | — | — | — | 5 | 5 | 10 | — | — | 1 | — |
| 11 | 85 | 5 | — | — | — | 4 | 5 | — | — | — | 1 |
| Comparative | | | | | | | | | | | |
| 1 | Bal | 2 | — | — | — | 15 | — | 2 | — | 2 | — |
| 2 | " | — | — | 1 | — | 5 | — | 19 | 2 | 18 | — |
| 3 | " | — | 2 | — | — | 3 | — | 3 | — | 1 | 0.1 |

TABLE 4

| | Tx − Tg = Δ T (K) | Structure |
|---|---|---|
| Inventive | | |
| 1 | 45 | Amorphous |
| 2 | 45 | ↑ |
| 3 | 45 | ↑ |
| 4 | 45 | ↑ |
| 5 | 50 | ↑ |
| 6 | 45 | ↑ |
| 7 | 34 | ↑ |
| 8 | 38 | ↑ |
| 9 | 40 | ↑ |
| 10 | 35 | ↑ |
| 11 | 23 | ↑ |
| Comparative | | |
| 1 | <5 | Amorphous + Crystal |
| 2 | <10 | Crystal |
| 3 | <5 | ↑ |

We claim:

1. An amorphous magnesium alloy comprising:

$Mg_aM_bAl_cX_dZ_e$, wherein M is at least one element selected from the group consisting of La, Ce, Y and misch metal, X is at least one element selected from the group consisting of Ni and Cu, and Z is at least one element selected from the group consisting of Mn, Zn, Zr, and Ti, and, a=70~90 at %, b=2~5 at %, c=1~9 at %, d=2~15 at %, e~0.1~8 at %, a+b+c+d+e=100 at %, the amorphous alloy having a thickness of 1 to 5 mm, and the difference (ΔT) between the magnesium alloy crystallization temperature (Tx) and the magnesium alloy glass transition temperature (Tg) is greater than 10 K.

2. An amorphous magnesium alloy according to claim 1, wherein the magnesium alloy is a cast alloy.

3. An amorphous magnesium alloy according to claim 2, said magnesium alloy having been cast by a primary cooling as a melt of the alloy flows through a flowing passage at a cooling speed Vc, thereby cooling the alloy melt to a temperature in the vicinity of the alloy melting point, and then having been subjected to a secondary cooling, in which the alloy melt has been fed into a mold and cooled to the glass transition temperature (Tg) at a cooling speed higher than the initial cooling speed Vc, Vc being such a cooling speed that partial crystallization occurs if the cooling speed in the secondary cooling is Vc.

4. An amorphous magnesium alloy comprising a thickness of from 1 to 5 mm, an amorphous structure after heating at 150° C., and a composition comprising $Mg_aM_bAl_cX_dZ_e$, wherein M is at least one element selected from the group consisting of La, Ce, Y, and misch metal, X is at least one element selected from the group consisting of Ni and Cu, and Z is at least one element selected from the group consisting of Mn, Zn, Zr, and Ti, and, a=70~90 at %, b=2~18 at %, c=1~9 at %, d=2~15 at %, e=0.1~8 at %, a+b+c+d+e=100 at % and the difference between the magnesium alloy crystallization temperature (Tx) and the magnesium alloy glass transition temperature (Tg) is greater than 10 K.

5. An amorphous magnesium alloy which remains amorphous when worked at ambient temperature comprising a thickness of from 1 to 5 mm, having a composition comprising $Mg_aM_bAl_cX_dZ_e$, wherein M is at least one element selected from the group consisting of La, Ce, Y, and misch metal, X is at least one element selected from the group consisting of Ni and Cu, and Z is at least one element selected from the group consisting of Mn, Zn, Zr, and Ti, and, a=70~90 at %, b=2~15 at %, c=1~9 at %, d=2~15 at %, e=0.1~8 at %, a+b+c+d+e=100% and the difference between the magnesium alloy crystallization temperature (Tx) and the magnesium alloy glass transition temperature (Tg) is greater than 10 K.

* * * * *